US008622857B2

(12) United States Patent
Lo

(10) Patent No.: US 8,622,857 B2
(45) Date of Patent: Jan. 7, 2014

(54) INFLATABLE BALL WITH RIB STRUCTURE

(76) Inventor: Jack Lo, Guang Dong (CN)

( * ) Notice: Subject to any disclaimer, the term of this patent is extended or adjusted under 35 U.S.C. 154(b) by 79 days.

(21) Appl. No.: 13/219,157

(22) Filed: Aug. 26, 2011

(65) Prior Publication Data

US 2013/0053193 A1 Feb. 28, 2013

(51) Int. Cl.
*A63B 41/08* (2006.01)

(52) U.S. Cl.
USPC ..... 473/604; 473/612

(58) Field of Classification Search
USPC ..... 473/604, 612, 614
See application file for complete search history.

(56) References Cited

U.S. PATENT DOCUMENTS

| | | | | |
|---|---|---|---|---|
| 2,131,756 | A * | 10/1938 | Roberts | 473/605 |
| 2,859,040 | A * | 11/1958 | Gow et al. | 473/596 |
| 3,508,750 | A | 4/1970 | Henderson | |
| RE27,106 | E * | 3/1971 | Henderson | 473/597 |
| 4,340,222 | A * | 7/1982 | Kerkenbush et al. | 473/610 |
| 5,865,697 | A | 2/1999 | Molitor et al. | |
| 6,073,581 | A * | 6/2000 | Wang | 119/51.01 |
| 6,200,239 | B1 * | 3/2001 | Kennedy et al. | 473/604 |
| 6,398,894 | B1 | 6/2002 | Lee | |
| 7,367,283 | B2 * | 5/2008 | Aboujaoude et al. | 119/707 |
| 2006/0148601 | A1 | 7/2006 | Ou | |
| 2007/0037642 | A1 * | 2/2007 | Chang | 473/604 |
| 2007/0105669 | A1 | 5/2007 | Maziarz | |
| 2007/0178997 | A1 * | 8/2007 | Chang | 473/603 |
| 2009/0011878 | A1 | 1/2009 | Ou | |
| 2010/0240479 | A1 | 9/2010 | Raynak et al. | |

FOREIGN PATENT DOCUMENTS

| | | | |
|---|---|---|---|
| EP | 2105170 | A1 | 9/2009 |
| GB | 326549 | A | 3/1930 |
| GB | 719467 | A | 12/1954 |
| GB | 853082 | A | 11/1960 |

OTHER PUBLICATIONS

Search Report received in corresponding GB Application No. 1114883.0 dated Oct. 28, 2011.
Office Action received in corresponding DE Application 102011111495.9 dtd Mar. 6, 2013.

* cited by examiner

*Primary Examiner* — Vishu K. Mendiratta
(74) *Attorney, Agent, or Firm* — Banner & Witcoff, Ltd.

(57) ABSTRACT

An inflatable ball includes interconnected first and second half ball bodies. The first half ball body has a first half ball wall with first inner and outer wall surfaces, and a first rib structure formed as one piece with the first half ball wall and projecting from one of the first inner and outer wall surfaces. The first half ball wall has a through hole extending through the first inner and outer wall surfaces, and a first annular connecting edge interconnecting circumferential ends of the first inner and outer wall surfaces. The second half ball body has a second half ball wall with second inner and outer wall surfaces, and a second rib structure projecting from one of the second inner and outer wall surfaces. A valve unit is attached to the first half ball body in connection with the through hole.

5 Claims, 16 Drawing Sheets

INFLATABLE BALL WITH RIB STRUCTURE

BACKGROUND OF THE INVENTION

1. Field of the Invention

This invention relates to a sports ball, and more particularly to an inflatable ball with a rib structure.

2. Description of the Related Art

A bladder of a conventional inflatable sports ball is made from either synthetic or natural rubber. To prevent swelling or deformation of the bladder due to increase of the inflation pressure, the following three manufacturing methods are usually employed:

1. Wrapping Yarns Around the Rubber Bladder

Referring to FIG. 1, a conventional inflatable ball includes a rubber bladder 1, a wrapping yarn layer 2 covering an outer surface of the rubber bladder 1, and a rubber outer cover layer 3 covering the wrapping yarn layer 2.

Referring to FIG. 2, another conventional inflatable ball includes a rubber bladder 1, a wrapping yarn layer 2 covering an outer surface of the rubber bladder 1, and an outer cover layer 301 covering the wrapping yarn layer 2 and made from a plurality of sewn leather pieces.

Referring to FIG. 3, still another conventional inflatable ball includes a rubber inner bladder 1, a wrapping yarn layer 2 covering an outer surface of the rubber inner bladder 1, a rubber outer bladder 4 covering the wrapping yarn layer 2, and a plurality of adhering pieces 5 fixed to an outer surface of the rubber outer bladder 4 and made of a PU (polyurethane) or leather material.

2. Wrapping a Fabric Cloth Layer Around the Rubber Bladder

Referring to FIG. 4, a conventional inflatable ball includes a rubber bladder 1, a fabric cloth layer 6 covering an outer surface of the rubber bladder 1 and made from a plurality of interconnected fabric cloth pieces 601, and a rubber outer cover layer 3 covering the fabric cloth layer 6.

Referring to FIG. 5, another conventional inflatable ball includes a rubber bladder 1, a fabric cloth layer 6 covering an outer surface of the rubber bladder 1 and made from a plurality of interconnected fabric cloth pieces 601, and an outer cover layer 301 covering the fabric cloth layer 6 and made from a plurality of sewn leather pieces.

Referring to FIG. 6, still another conventional inflatable ball includes a rubber inner bladder 1, a fabric cloth layer 6 covering an outer surface of the rubber inner bladder 1 and made from a plurality of interconnected fabric cloth pieces 601, a rubber outer bladder 4 covering the fabric cloth layer 6, and a plurality of adhering pieces 5 fixed to an outer surface of the rubber outer bladder 4 and made of a PU or leather material.

3. Attaching Fabric Lining Layers to an Inner Surface of an Outer Cover Layer

Referring to FIG. 7, a conventional inflatable ball includes a rubber bladder 1, an outer cover layer 7 covering the rubber bladder 1 and made from a plurality of sewn leather pieces 701, and a plurality of fabric lining layers 703 adhered to an inner surface of the outer cover layer 7.

Although the aforesaid methods can prevent over-inflation or deformation of the bladder, many devices, manufacturing procedures, and laborers are required to complete a production. Further, the rubber bladder 1, the rubber outer cover layer 3 or the rubber outer bladder 4 after vulcanization at high temperature changes its molecular structure, so that the chance of being recycled is low. Moreover, many kinds of additives (such as sulfur) must be mixed with the raw rubber before vulcanization at high temperature may be performed. During this process, contamination is likely to occur, and offensive odor is created during burning, thereby causing harmful effects on human body.

SUMMARY OF THE INVENTION

Therefore, an object of the present invention is to provide a strong and easy to manufacture inflatable ball with a rib structure.

According to this invention, an inflatable ball comprises a first half ball body, a second half ball body, and a valve unit. The first half ball body has a first half ball wall, and a first rib structure formed as one piece with the first half ball wall. The first half ball wall has a first inner wall surface, a first outer wall surface, a through hole extending through the first inner and outer wall surfaces, and a first annular connecting edge interconnecting circumferential ends of the first inner and outer wall surfaces. The first rib structure projects from one of the first inner and outer wall surfaces. The other one of the first inner and outer wall surfaces is free of the first rib structure. The second half ball body is connected fixedly to and cooperates with the first half ball body to define an inflation chamber. The second half ball body has a second half ball wall, and a second rib structure formed as one piece with the second half ball wall. The second half ball wall has a second inner wall surface, a second outer wall surface, and a second annular connecting edge interconnecting circumferential ends of the second inner and outer wall surfaces. The second rib structure projects from one of the second inner and outer wall surfaces. The other one of the second inner and outer wall surfaces is free of the second rib structure. The valve unit is attached to the first half ball body in connection with the through hole.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
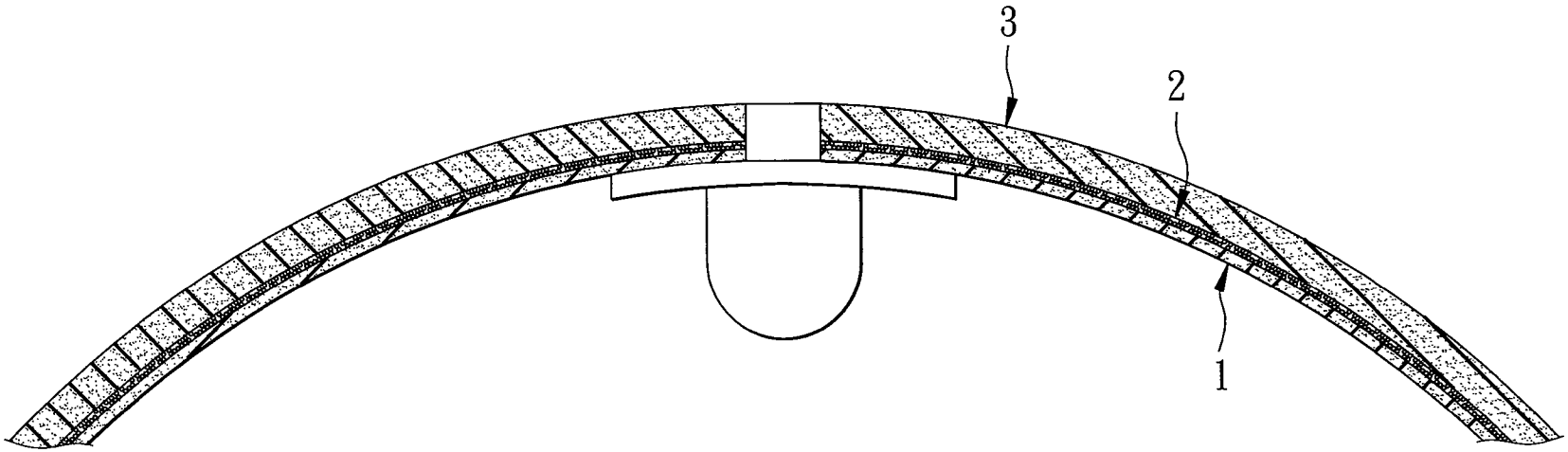
FIG. 1 PRIOR ART
FIG. 1 is a fragmentary partly sectional view of a conventional inflatable ball.
Figure 2:
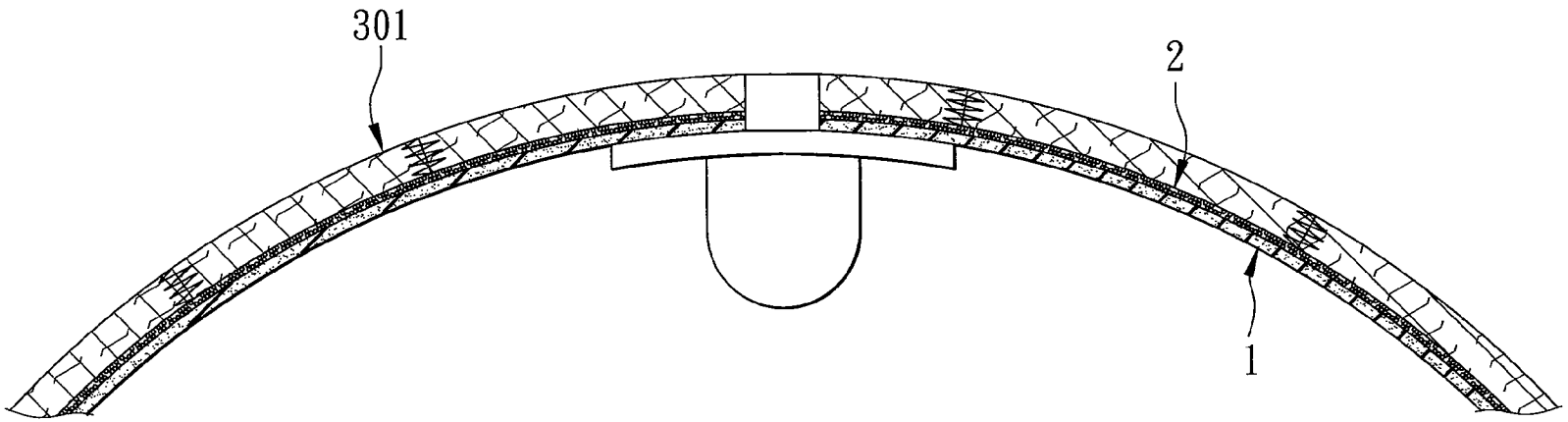
FIG. 2 PRIOR ART
FIG. 2 is a fragmentary partly sectional view of another conventional inflatable ball.

Before this invention is described in detail, it should be noted that, in the following description, similar elements are designated by the same reference numerals.

Referring to FIGS. 8 to 11, an inflatable ball according to the first preferred embodiment of this invention comprises a first half ball body 10, a second half ball body 40, and a valve unit 30.

The first half ball body 10 has a first half ball wall 11, a first rib structure 12, a first annular flange 13, and two first aligning elements 14, 15. The first half ball wall 11 has a first inner wall surface 111, a first outer wall surface 112, a through hole 113 extending through the first inner and outer wall surfaces 111, 112, and a first annular connecting edge 114 interconnecting circumferential ends of the first inner and outer wall surfaces 111, 112.

The first rib structure 12 is formed as one piece with the first half ball wall 11, and projects from one of the first inner and outer wall surfaces 111, 112. The other one of the first inner and outer wall surfaces 111, 112 is free of the first rib structure 12. In this embodiment, the first rib structure 12 projects inwardly from the first inner wall surface 111.

The first annular flange 13 projects outwardly and radially from the first outer wall surface 112 and the first annular connecting edge 114. The two first aligning elements 14, 15 are provided diametrically opposite to each other on the first annular flange 13. In this embodiment, the first aligning element 14 is configured as a protrusion that protrudes toward the second half ball body 40, and the first aligning element 15 is configured as a groove.

Figure 9:
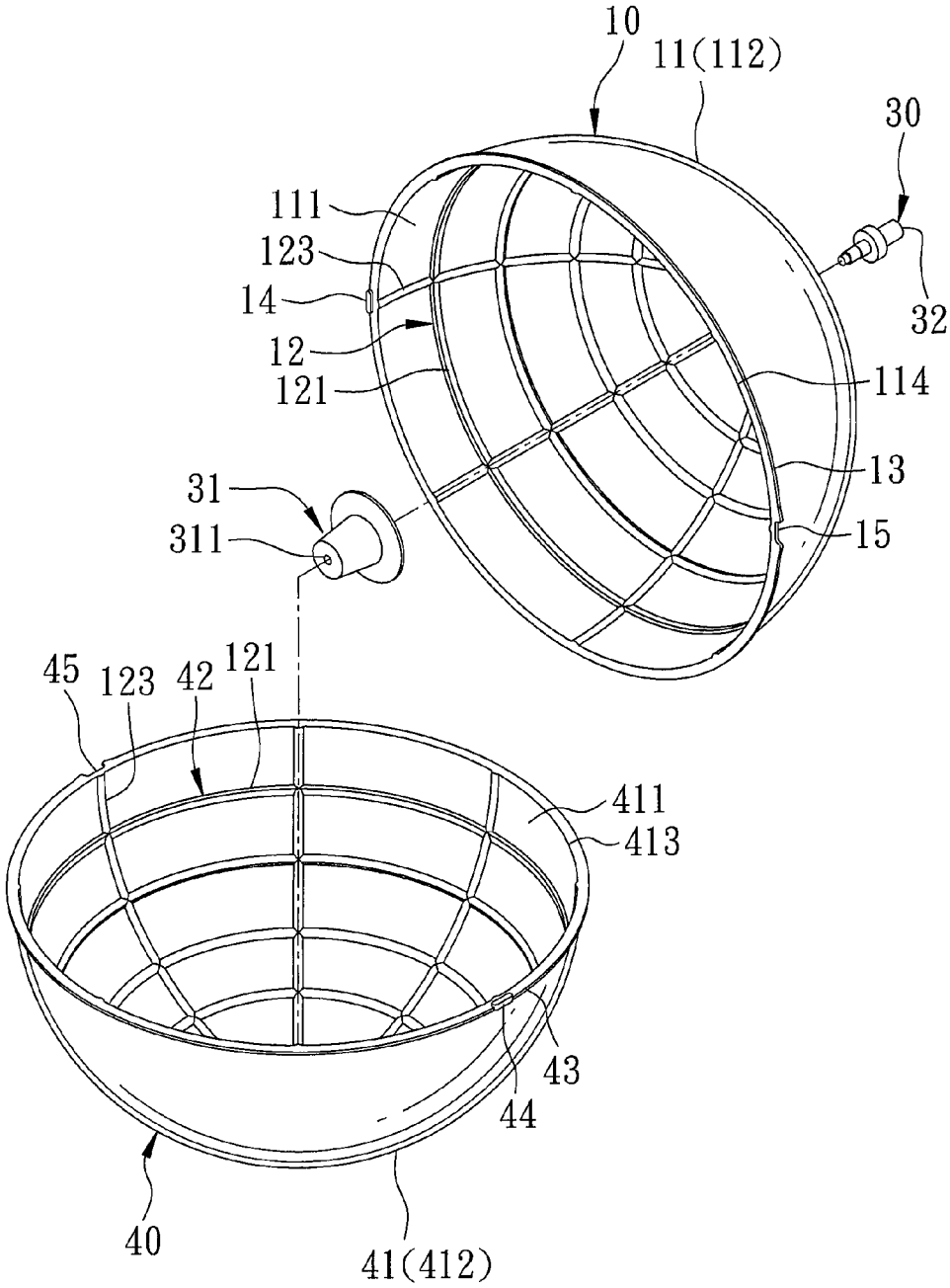
FIG. 9 is an exploded perspective view of the first preferred embodiment.
Figure 10:
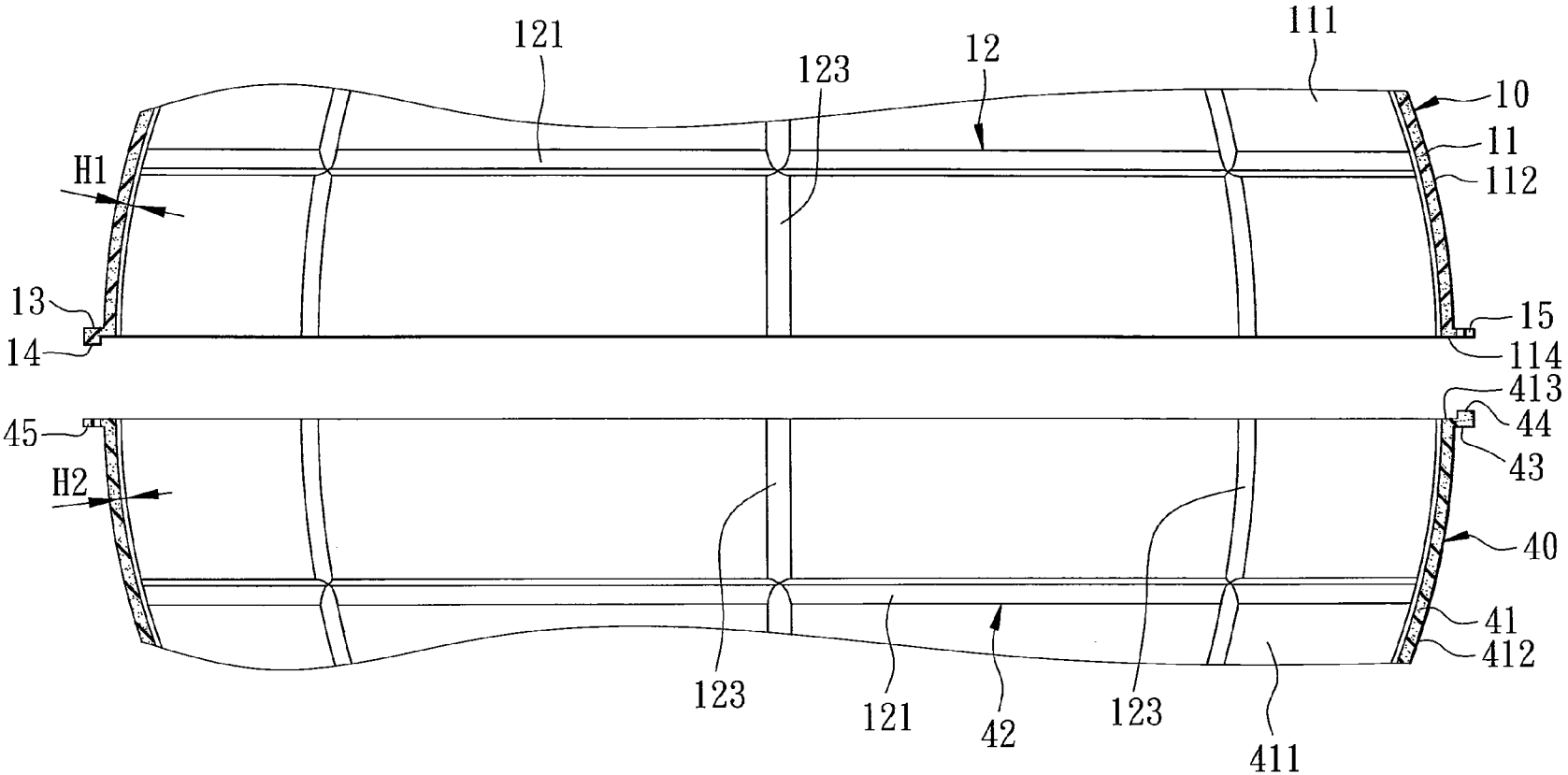
FIG. 10 is a fragmentary exploded partly sectional view of the first preferred embodiment.
Figure 11:
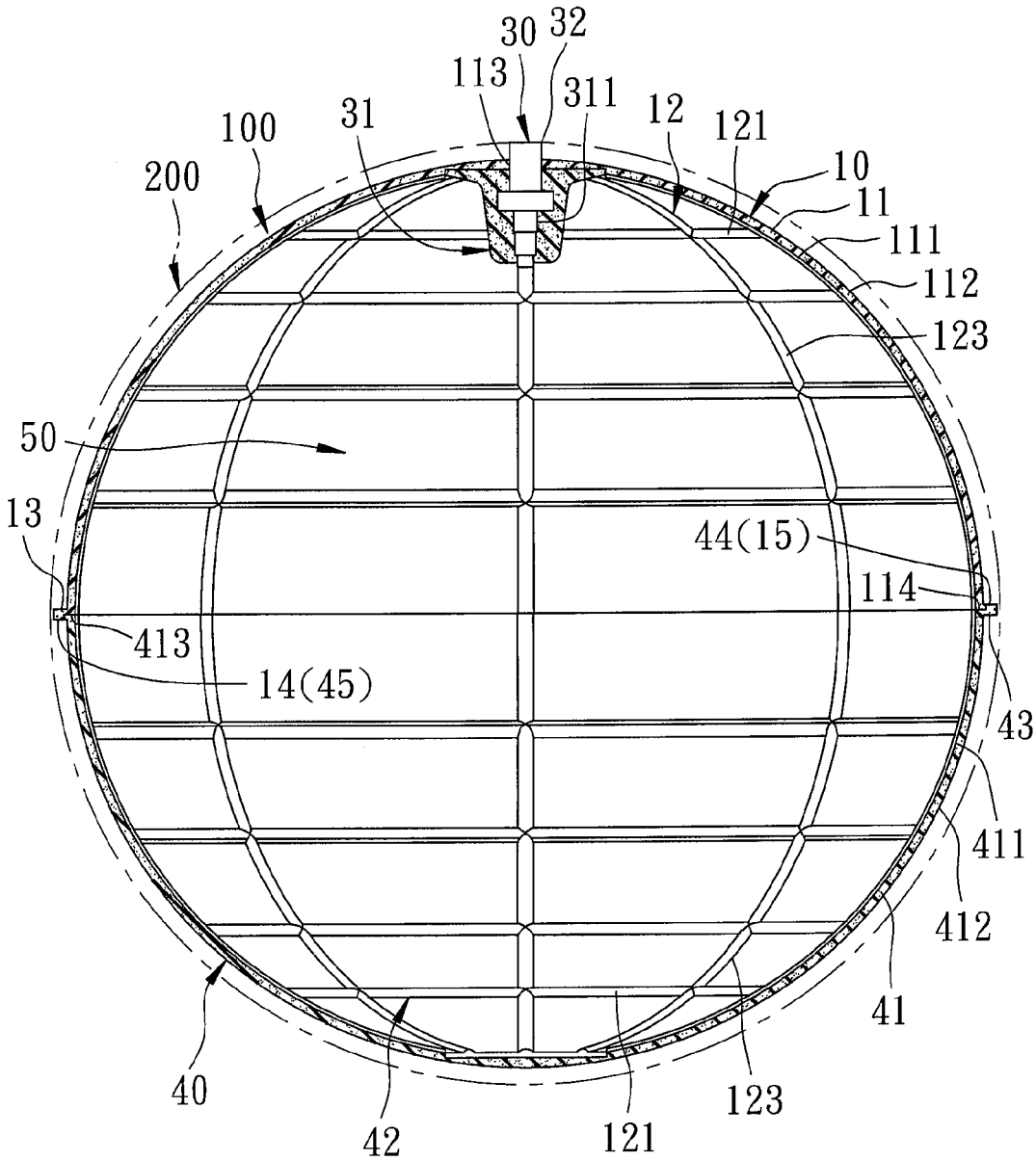
FIG. 11 is a partly sectional view of the first preferred embodiment in an assembled state.

With reference to FIGS. 9 to 11, the first and second half ball bodies 10, 40 are connected fixedly to each other, and cooperatively define an inflation chamber 50. Each of the first and second half ball bodies 10, 40 is made of a material selected from a group consisting of thermoplastic polyurethane (TPU), thermoplastic elastomer (TPE), thermoplastic olefin (TPO), thermoplastic rubber (TPR), and ethylene-vinyl acetate (EVA). Preferably, each of the first and second half ball bodies 10, 40 is made of TPU. Further, each of the first and second half ball bodies 10, 40 is produced through an injection molding process. The second half ball body 40 is connected fixedly to the first half ball body 10 through a thermal welding process.

The second half ball body 40 has a second half ball wall 41, a second rib structure 42, a second annular flange 43, and two second aligning elements 44, 45. The second half ball wall 41 has a second inner wall surface 411, a second outer wall surface 412, and a second annular connecting edge 413 interconnecting circumferential ends of the second inner and outer wall surfaces 411, 412.

The second rib structure 42 is formed as one piece with the second half ball wall 41, and projects from one of the second inner and outer wall surfaces 411, 412. The other one of the second inner and outer wall surfaces 411, 412 is free of the second rib structure 42. In this embodiment, the second rib structure 42 projects inwardly from the second inner wall surface 411. Each of the first and second rib structures 12, 42 includes a plurality of interconnected ribs forming a network. The interconnected ribs include a plurality of annular ribs 121 axially spaced apart from each other, and a plurality of arc-shaped ribs 123 intersecting the annular ribs 121. Each rib 121, 123 of the first rib structure 12 has a height (H1) from the first inner wall surface 111, which is not smaller than 1 mm. Each rib 121, 123 of the second rib structure 42 has a height (H2) from the second inner wall surface 411, which is not smaller than 1 mm.

The second annular flange 43 projects outwardly and radially from the second outer wall surface 412 and the second annular connecting edge 413, and abuts against the first annular flange 13. The two second aligning elements 44, 45 are provided diametrically opposite to each other on the second annular flange 43. The second aligning element 44 is configured as a protrusion that protrudes toward the first half ball body 10 and that engages the first aligning element 15. The second aligning element 45 is configured as a groove that receives engagingly the first aligning element 14. In this embodiment, the first and second rib structures 12, 42 are symmetrical to each other.

The valve unit 30 is attached to the first half ball body 10, and includes a valve seat 31 and a valve member 32. The valve seat 31 is connected to the first inner wall surface 111 at a position corresponding to that of the through hole 113, and has a receiving hole 311 communicating fluidly with the through hole 113. In this embodiment, the valve seat 31 is made of a material selected from a group consisting of thermoplastic polyurethane (TPU) and rubber. If the valve seat 31 is made of TPU, the valve seat 31 is fixed to the first half ball wall 11 by using high frequency or ultrasonic wave heating. If the valve seat 31 is made of rubber, the valve seat 31 is fixed to the first half ball wall 11 by using adhesive. Preferably, the valve seat 31 is made of TPU, and is produced by an injection molding process. Further, the valve seat 31 may be connected integrally as one piece to the first inner wall surface 111.

With reference to FIG. 11, the valve member 32 is disposed in the receiving hole 311 of the valve seat 31, and extends through the through hole 113 in the first half ball wall 11. In this embodiment, the valve member 32 is made of rubber. Compressed air is supplied into the inflation chamber 50 through the valve member 32.

From the aforesaid description, the manufacturing process of the present invention can be explained briefly as follows:

1. Forming the first and second half ball bodies 10, 40 using an injection molding machine.

2. Fixing the valve seat 31 to the first inner wall surface 111 of the first half ball body 10 using a high frequency or ultrasonic wave heating or adhesive.

3. Connecting fixedly the first and second half ball bodies 10, 40 using a thermal welding process.

4. Inserting the valve member 32 through the through hole 113 in the first half ball wall 11 into the receiving hole 311 in the valve seat 31.

Through this, with reference to FIG. 11, the inflatable ball of this invention can be directly used as a bladder. An outer cover layer 200 (shown in phantom lines) may be covered around the bladder or inflatable ball to form an inflatable sports ball.

Figure 3:
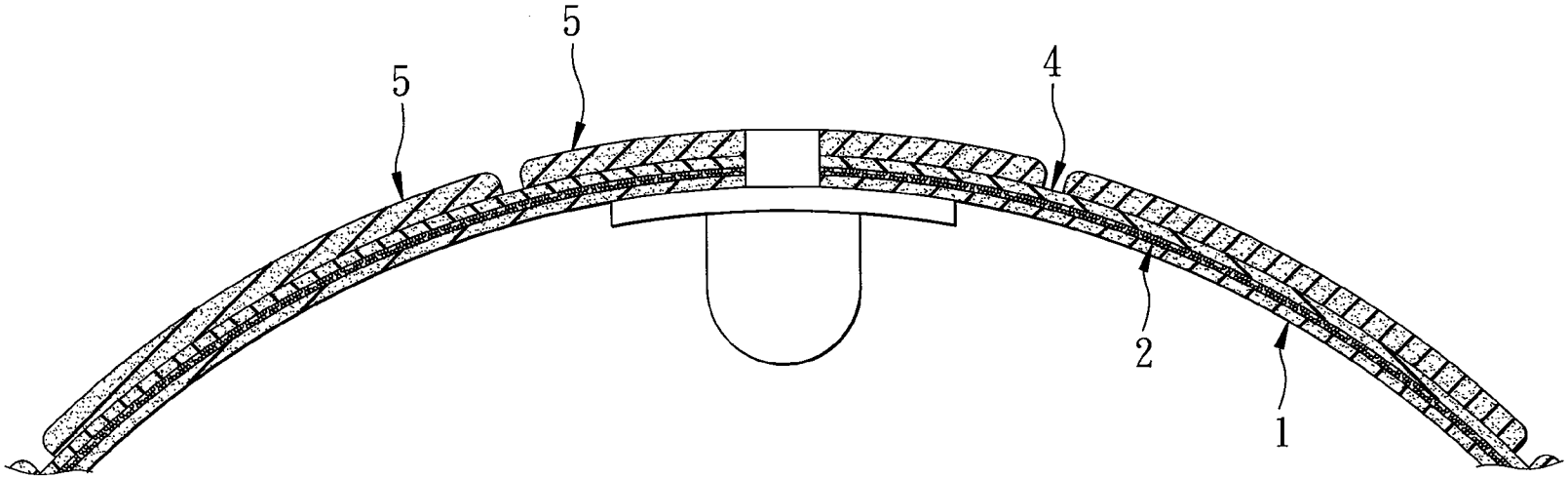
FIG. 3 PRIOR ART
FIG. 3 is a fragmentary partly sectional view of still another conventional inflatable ball.
Figure 4:
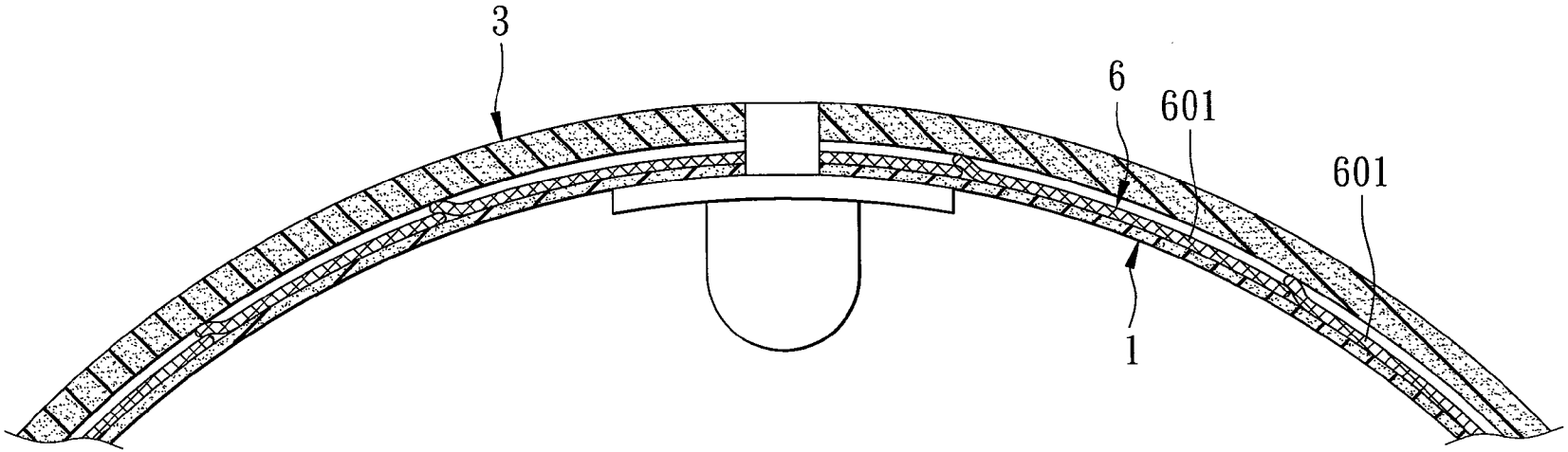
FIG. 4 PRIOR ART
FIG. 4 is a fragmentary partly sectional view of yet another conventional inflatable ball.
Figure 5:
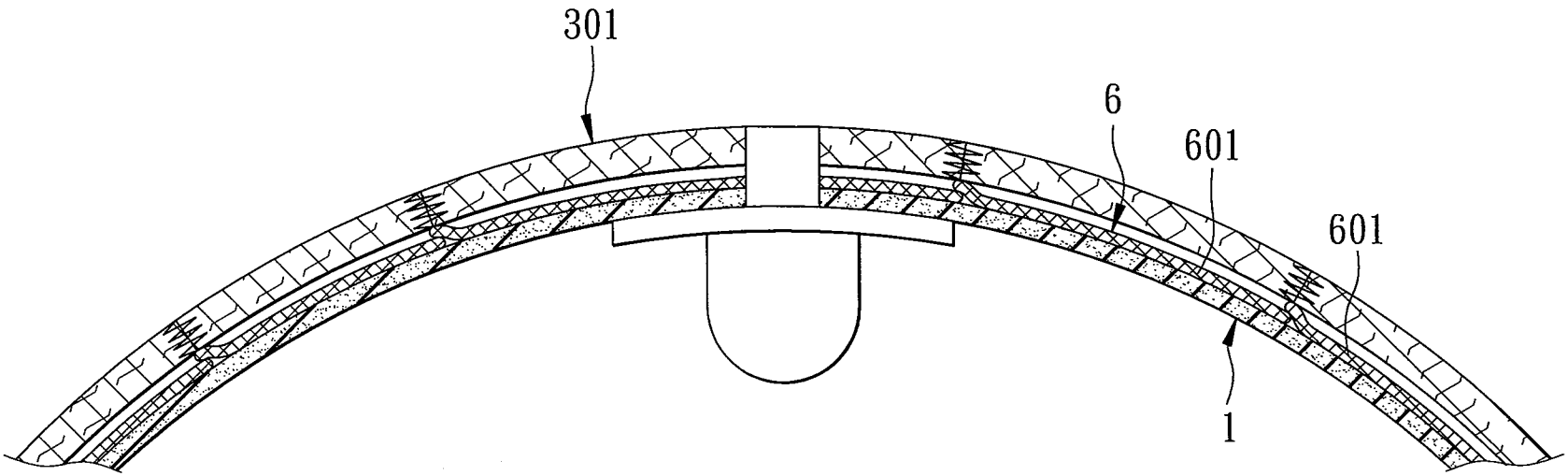
FIG. 5 PRIOR ART
FIG. 5 is a fragmentary partly sectional view of still yet another conventional inflatable ball.
Figure 6:
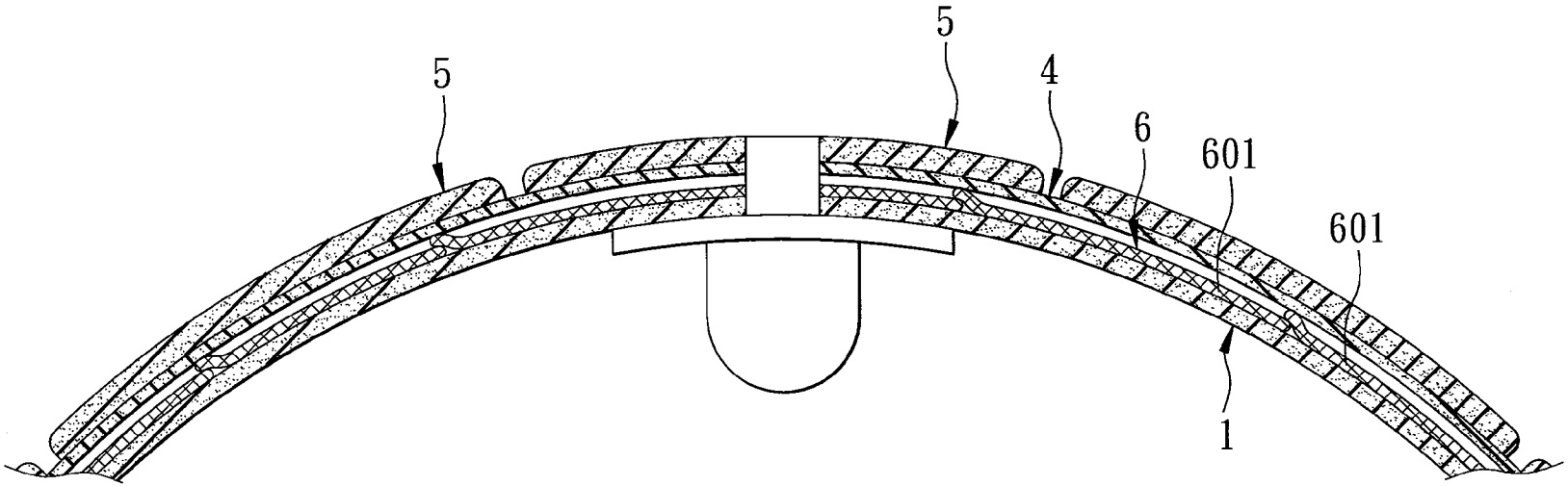
FIG. 6 PRIOR ART
FIG. 6 is a fragmentary partly sectional view of still yet another conventional inflatable ball.
Figure 7:
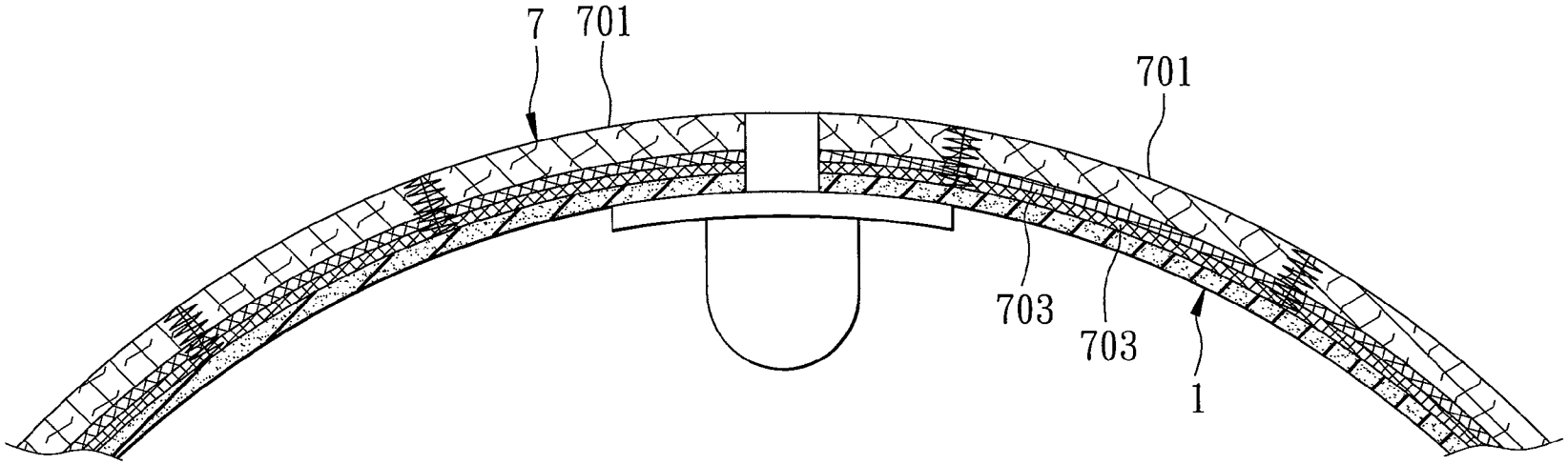
FIG. 7 PRIOR ART
FIG. 7 is a fragmentary partly sectional view of still yet another conventional inflatable ball.
Figure 8:
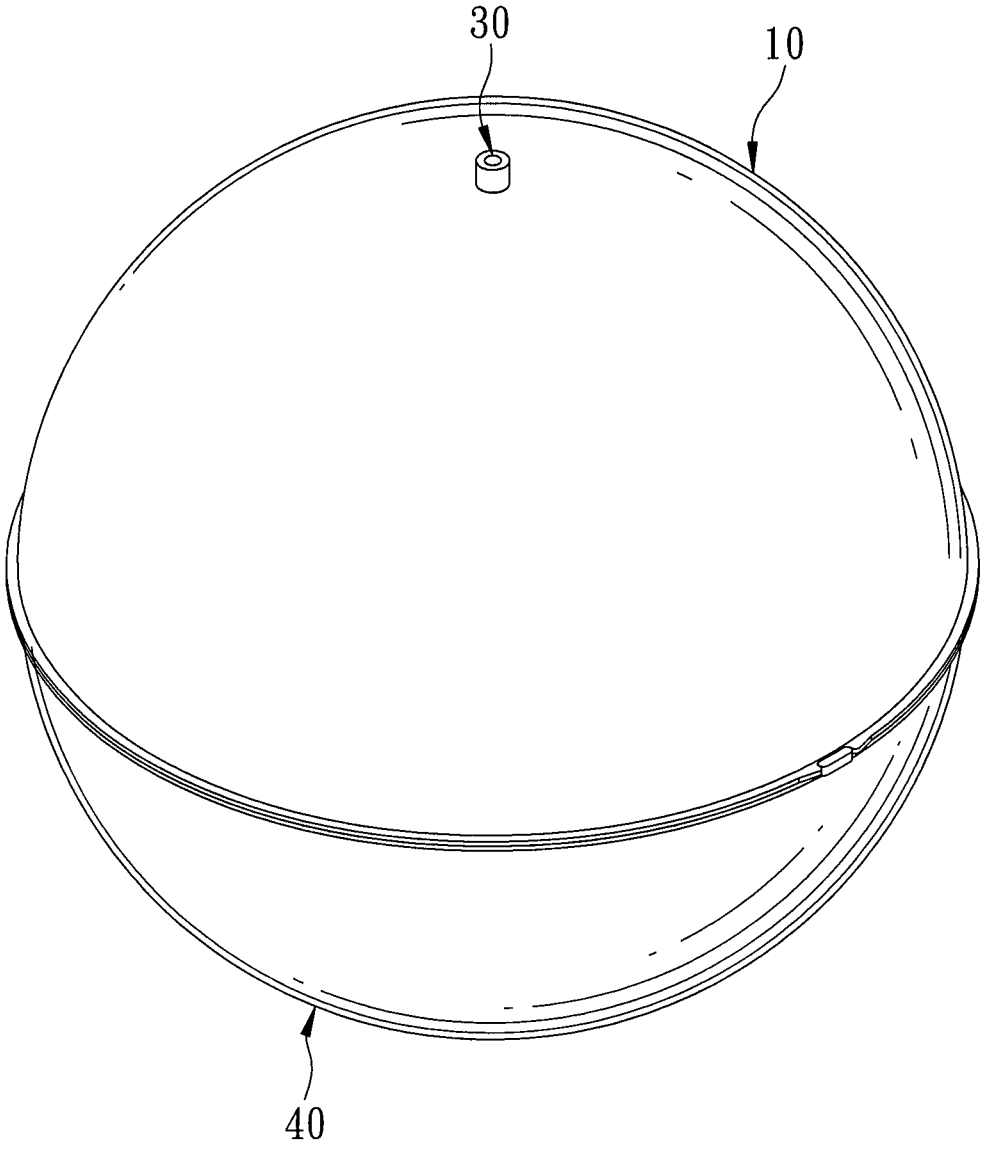
FIG. 8 is a perspective view of an inflatable ball according to the first preferred embodiment of this invention.

The advantages of the present invention can be summarized as follows:

1. The first and second rib structures 12, 42 are used to effectively restrict expansion and deformation of the first and second half ball walls 11, 41, so that during manufacture of the present invention, there is no need to perform the reinforcing manufacturing process described in the aforesaid conventional inflatable ball, such as wrapping a yarn layer 2 (see FIG. 1) around the rubber bladder, fixing adhering pieces 5 (see FIG. 3) to an outer surface of the outer cover layer, or adhering fabric lining layers 703 (see FIG. 7) to an inner surface of the outer cover layer. Compared to the conventional inflatable ball, the production of the present invention only requires a matured and developed injection molding machine and a low cost thermal welding process to greatly reduce the manufacturing process. Further, the machine and the process are simple to operate, and require less laborers. Moreover, because the present invention does not need yarns, adhering pieces, or fabric lining layers, the production costs can be minimized.

2. The first and second rib structures 12, 42 are connected integrally as one piece with the first and second half ball walls 11, 41, respectively, are hidden inside the first and second half ball walls 11, 41, and have good tensile and tear strength, so that when the present invention is at a constant pressure, it will not expand further. As such, the original shape of the inflatable ball can be maintained after use. Hence, when the present invention is used as a bladder of an inflatable sports ball, the appearance of the inflatable sports ball can be effectively maintained.

3. Because the first and second half ball bodies 10, 40 are made by injection molding, they can be produced with a uniform thickness, with high precision, and low damages. Further, they can be mass produced using a single mold. Compared to the conventional rubber bladder which can only be made using one mold to produce one rubber bladder, the production capacity of the present invention can be effectively increased.

4. The first and second half ball bodies 10, 40 use the inter-engagement of the first and second aligning elements 14, 15, 45, 44 to align with each other during the thermal welding process. Hence, when the present invention is used as a bladder of an inflatable sports ball, the sports ball as a whole is balanced.

5. When the present invention is used as a bladder of an inflatable sports ball, because there are no yarns, adhering pieces, or fabric lining layers between the present invention and the outer cover layer 200, the outer cover layer 200 is soft and comfortable to touch.

6. The finished product of the present invention is strong, it can bear a pressure of 1000 kg/cm$^2$ without bursting. Its strength is 50 times that of the conventional rubber bladder, or 25 times that of the bladder with a wrapping yarn layer or a fabric cloth layer.

7. The first and second half ball bodies 10, 40 are made of TPU which has a specific gravity of about 1.0~1.2 that is lower than that of the conventional rubber bladder (about 1.3~1.5). Under the same weight, the thickness of the present invention can be increased to more than 30%.

8. The first and second half ball bodies 10, 40 are made of TPU which has good elongation strength and abrasion resistance, excellent waterproof and solvent resistance, good impermeability (about twice that of synthetic rubber, five times that of natural rubber), and good elasticity (about three times that of synthetic rubber, two times that of natural rubber). As such, the appearance of the inflatable ball can be maintained after inflation. Hence, the inflatable ball is suitable as a bladder of an inflatable sports ball, and can effectively maintain the appearance of the inflatable sports ball after use.

9. The first and second half ball bodies 10, 40 are made of TPU, and can be 100% recycled. Compared to the conventional inflatable ball, the present invention is not only environmentally friendly, but also will not cause allergy or other bad effects to human body.

Figure 12:
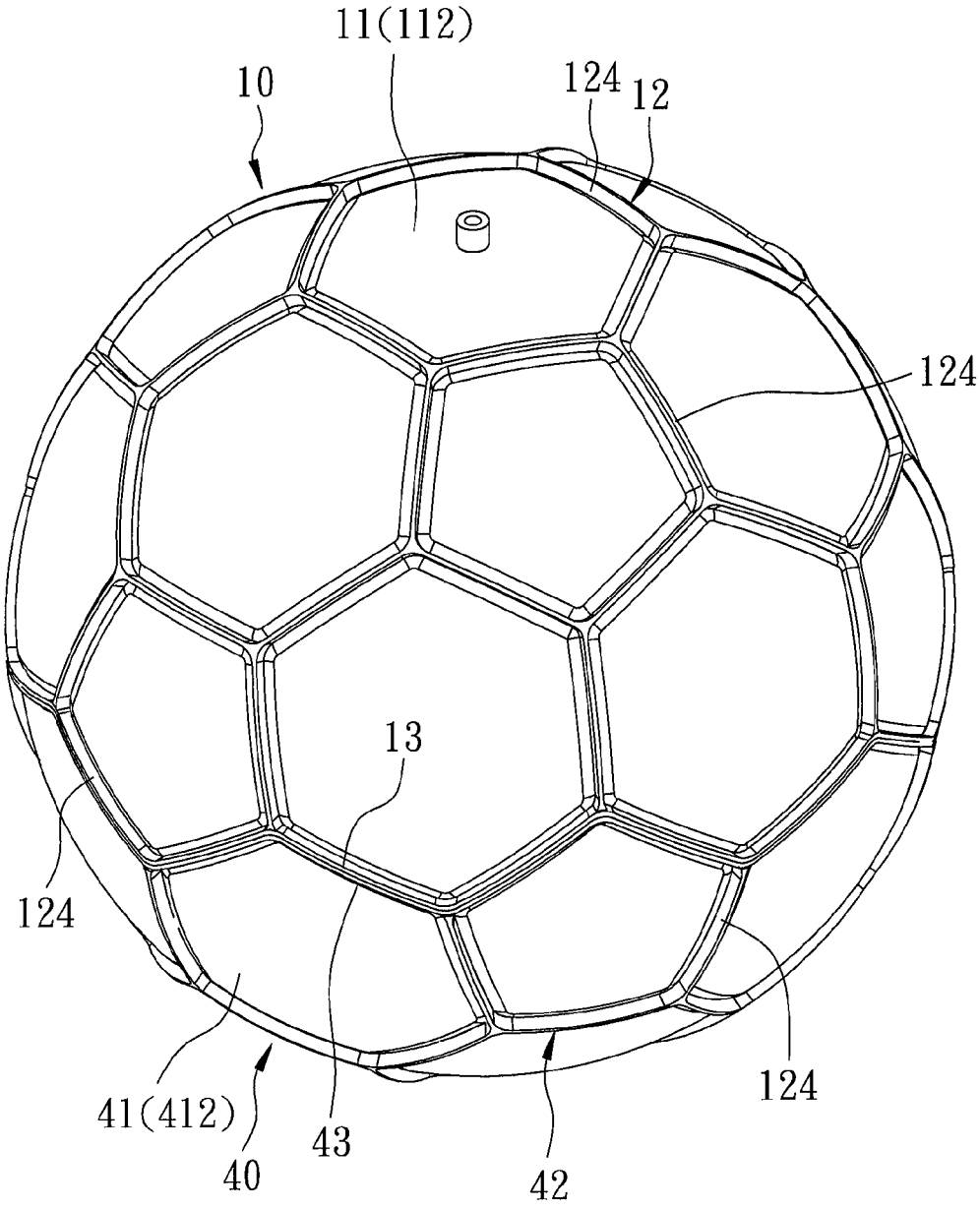
FIG. 12 is a perspective view of an inflatable ball according to the second preferred embodiment of this invention.
Figure 13:
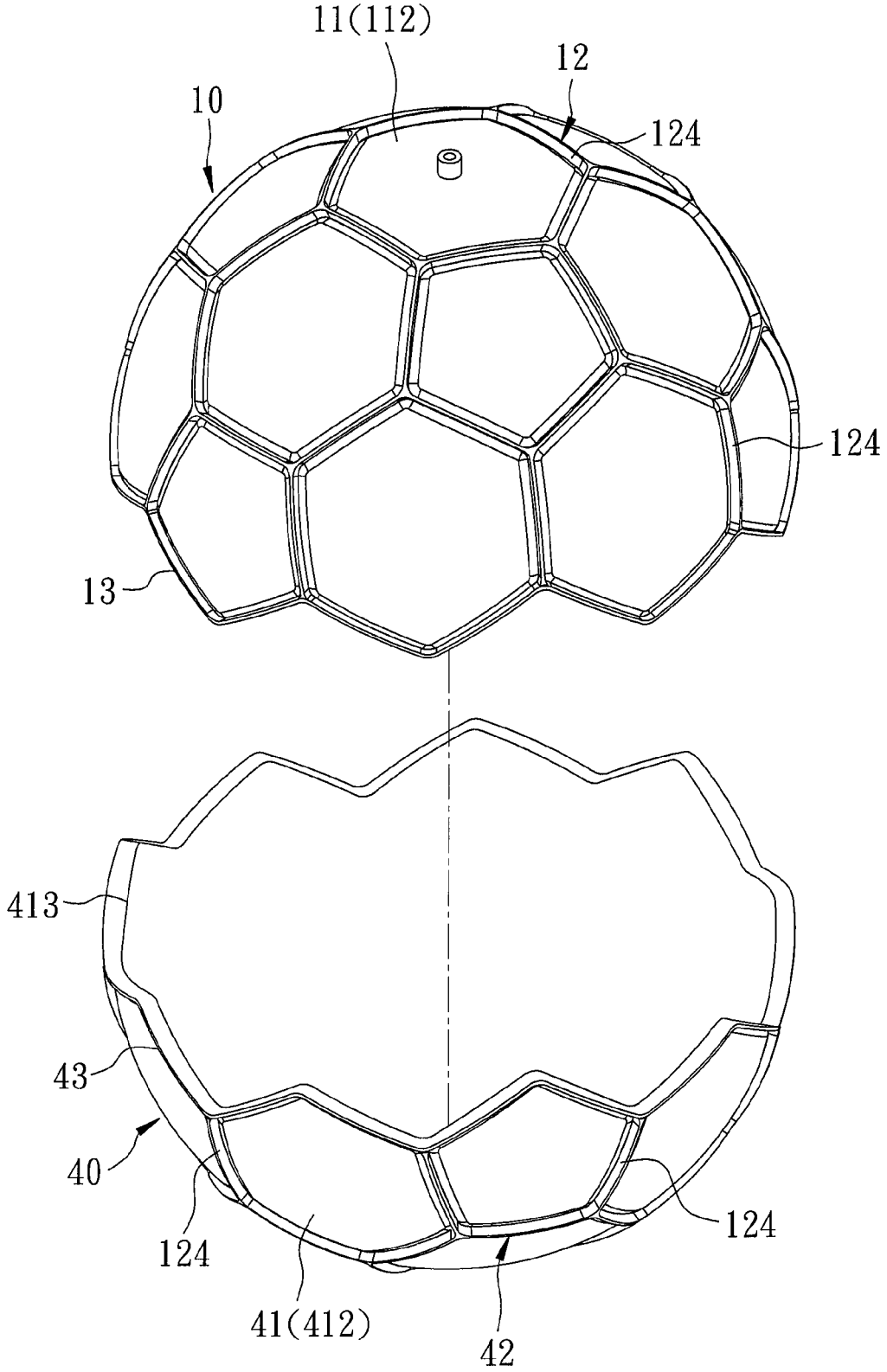
FIG. 13 is an exploded perspective view of the second preferred embodiment.
Figure 14:
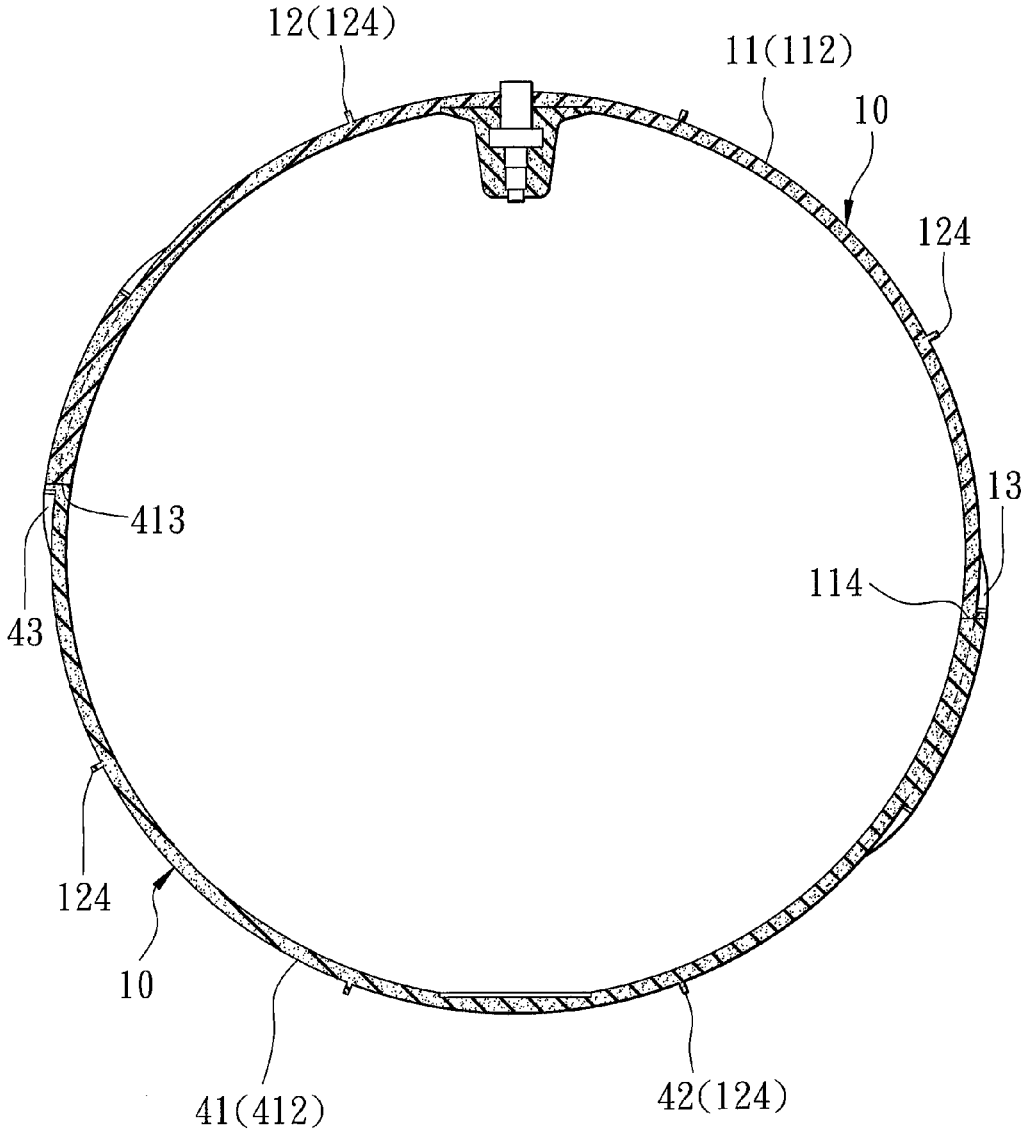
FIG. 14 is a sectional view of the second preferred embodiment in an assembled state.

Referring to FIGS. 12 to 14, the inflatable ball according to the second preferred embodiment of this invention is shown to be similar to the first preferred embodiment. However, in this embodiment, the first rib structure 12 of the first half ball body 10 is formed as one piece with the first outer wall surface 112 of the first half ball wall 11, and is connected to the first annular flange 13. The second rib structure 42 is formed as one piece with the second outer wall surface 412 of the second half ball wall 41, and is connected to the second annular flange 43. Further, each of the first and second annular connecting edges 114, 413 is a wavy edge, and each of the first and second annular flanges 13, 43 has a wavy shape corresponding to that of a respective one of the first and second annular connecting edges 114, 413. The first and second annular connecting edges 114, 413 are connected to each other in a complementary manner. The first and second annular flanges 13, 43 abut against each other in a complementary manner. The interconnected ribs of each of the first and second rib structures 12, 42 include a plurality of interconnected polygonal ribs 124 that define a plurality of cell areas 122, 422, respectively.

The purpose and advantages of the first preferred embodiment can be similarly achieved using the second preferred embodiment of the present invention.

Figure 15:
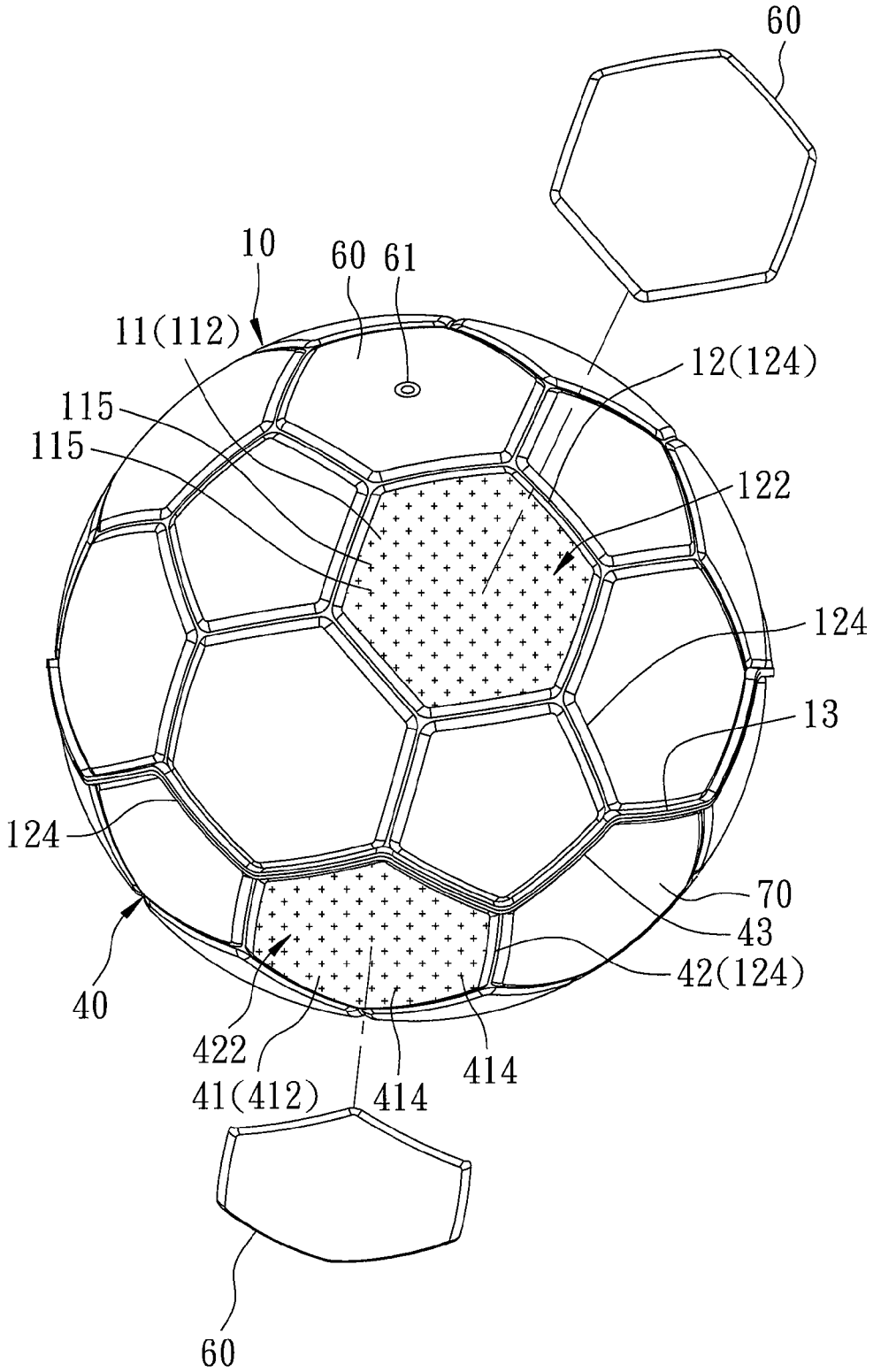
FIG. 15 is a partially exploded perspective view of an inflatable ball according to the third preferred embodiment of this invention.
Figure 16:
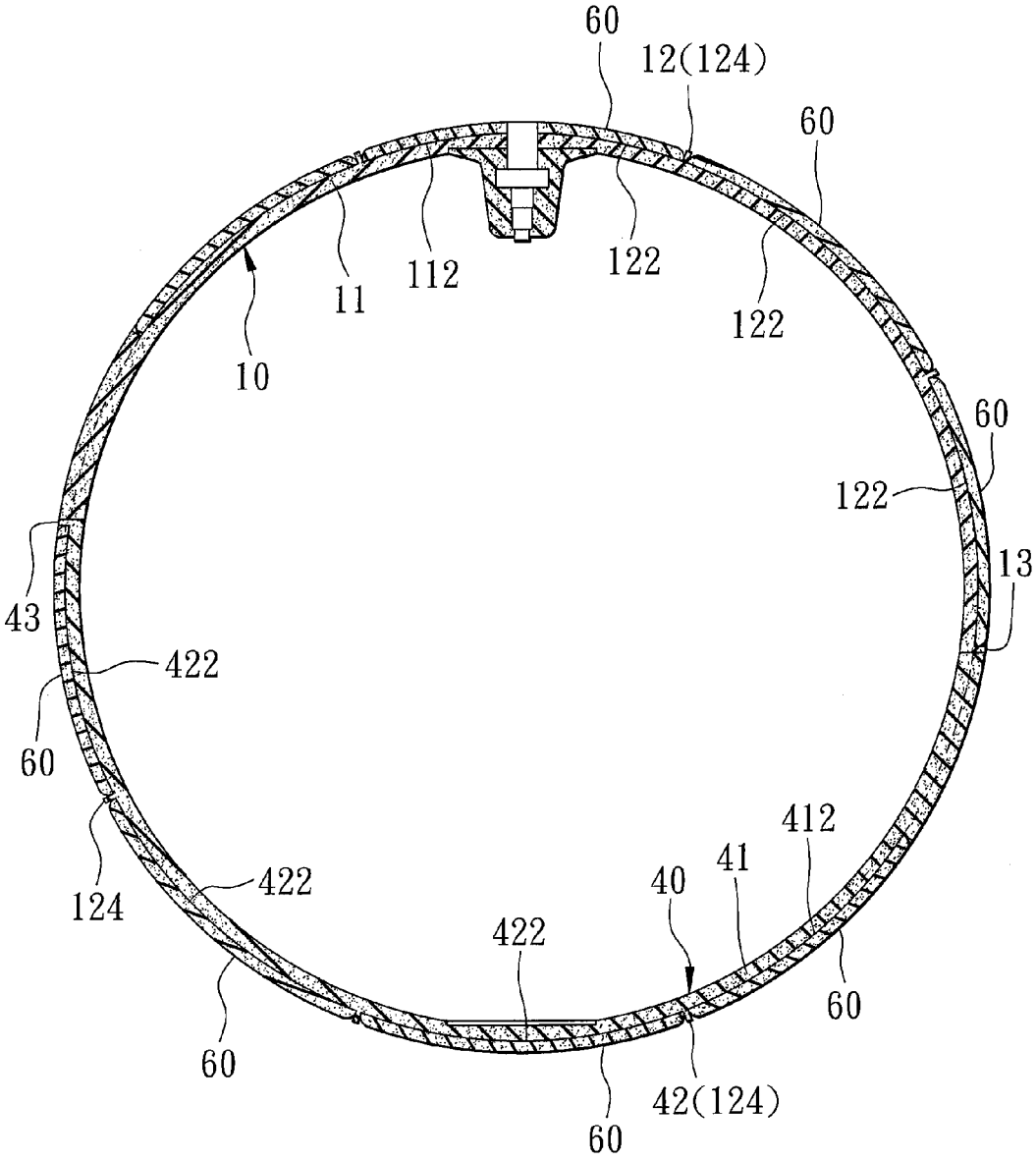
FIG. 16 is a sectional view of the third preferred embodiment in an assembled state.

Referring to FIGS. 15 and 16, the inflatable ball according to the third preferred embodiment of this invention is shown to be similar to the second preferred embodiment. However, in this embodiment, the inflatable ball further comprises a plurality of leather pieces 60 disposed respectively in the cell areas 122, 422. The cell areas 122, 422 have knurled regions 115, 414. The knurled regions 115, 414 of the cell areas 122, 422 are formed by engraving an inner surface of the injection mold, so that the first and second outer wall surfaces 112, 412 of the first and second half ball walls 11, 41 are formed directly and respectively with the knurled regions 115, 414 during the injection molding process. The leather pieces 60 are made of PVC synthetic leather or PU leather, and are fixed to the respective knurled regions 115, 414 of the cell areas 122, 422 using adhesive. One of the leather pieces 60 has an aperture 61 corresponding in position to the through hole 113.

The knurled regions 115, 414 of the cell areas 122, 422 enhance the bonding strength between the leather pieces 60 and the adhesive, dispensing with the complicated manufacturing process of the conventional rubber bladder which requires buffing and finishing prior to application of adhesive.

Hence, the third preferred embodiment not only can achieve the purpose and advantages described in the first preferred embodiment, but can also serve as a bladder of the conventional inflatable ball. Further, since in this embodiment there is no need to wrap yarns or fabric cloth layer around the bladder as is done in the conventional inflatable ball in order to perform a second vulcanization of the rubber bladder, the manufacturing process and use of materials of this embodiment can be greatly reduced.

Moreover, since the first and second half ball bodies 10, 40 are made of TPU which has good abrasion resistance, excellent waterproof and solvent resistance, the first and second half ball bodies 10, 40 may be added with colored paste depending on the requirement to directly produce a desired color. As such, the third preferred embodiment may be directly used as an inflatable sports ball.

In summary, the inflatable ball of the present invention not only has a strong structure, but also has a simplified manufacturing process to facilitate production thereof. Hence, the object of the present invention can be achieved.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. An inflatable ball comprising:

a first half ball body having a first half ball wall, and a first rib structure formed as one piece with said first half ball wall, said first half ball wall having a first inner wall surface, a first outer wall surface, a through hole extending through said first inner and outer wall surfaces, and a first annular connecting edge interconnecting circumferential ends of said first inner and outer wall surfaces, said first rib structure projecting from one of said first inner and outer wall surfaces, the other one of said first inner and outer wall surfaces being free of said first rib structure;

a second half ball body connected fixedly to and cooperating with said first half ball body to define an inflation chamber, said second half ball body having a second half ball wall, and a second rib structure formed as one piece with said second half ball wall, said second half ball wall having a second inner wall surface, a second outer wall surface, and a second annular connecting edge interconnecting circumferential ends of said second inner and outer wall surfaces, said second rib structure projecting from one of said second inner and outer wall surfaces, the other one of said second inner and outer wall surfaces being free of said second rib structure; and a valve unit attached to said first half ball body in connection with said through hole;

wherein said first and second rib structures are symmetrical to each other, each of said first and second rib structure including a plurality of interconnected ribs forming a network;

wherein said interconnected ribs include a plurality of annular ribs, which are axially spaced apart from each other, and a plurality of arc-shaped ribs intersecting said annular ribs;

wherein said first half ball body further has a first annular flange projecting outwardly and radially from said first outer wall surface and said first annular connecting edge, and two angularly spaced-apart first aligning elements provided on said first annular flange, said second half ball body further having a second annular flange projecting outwardly and radially from said second outer wall surface and said second annular connecting edge, and two angularly spaced-apart second aligning elements provided on said second annular flange, said first and second annular flanges abutting against each other;

wherein one of said first aligning elements is configured as a protrusion that protrudes from said first annular flange toward said second half ball body, the other one of said first aligning elements being configured as a groove, one of said second aligning elements being configured as a protrusion that protrudes from said second annular flange toward said first half ball body and that is received in said groove of the other one of said first aligning elements, the other one of said second aligning elements being configured as a groove that receives said protrusion of said first aligning elements; and wherein said first annular flange is indented radially to form said groove of the other one of said first aligning elements, and said second annular flange is indented radially to form said groove of the other one of said second aligning elements.

2. The inflatable ball of claim 1, wherein said first rib structure includes a plurality of ribs having a height from said first inner wall surface, which is not smaller than 1 mm, said second rib structure includes a plurality of ribs having a height from said second inner wall surface, which is not smaller than 1 mm.

3. The inflatable ball of claim 1, wherein each of said first and second half ball bodies is made of a material selected from a group consisting of thermoplastic polyurethane (TPU), thermoplastic elastomer (TPE), thermoplastic olefin (TPO), thermoplastic rubber (TPR), and ethylene-vinyl acetate (EVA).

4. The inflatable ball of claim 1, wherein said valve unit includes a valve seat connected integrally as one piece to said first inner wall surface.

5. The inflatable ball of claim 4, wherein said valve seat is made of a material selected from a group consisting of thermoplastic polyurethane and rubber.

* * * * *